US005618481A

United States Patent [19]

Vita et al.

[11] Patent Number: 5,618,481

[45] Date of Patent: Apr. 8, 1997

[54] PROCESS OF MAKING MULTIFILAMENT YARNS OF THERMOPLASTIC POLYMERS BASED ON TETRAFLUOROETHYLENE

[75] Inventors: Giandomenico Vita, Como; Giuseppe Ajroldi, Milan; Mario Miani, Rho, all of Italy

[73] Assignee: Ausimont S.p.A., Milan, Italy

[21] Appl. No.: 658,090

[22] Filed: Jun. 4, 1996

Related U.S. Application Data

[62] Division of Ser. No. 457,095, Jun. 1, 1995, Pat. No. 5,552, 219, which is a division of Ser. No. 144,189, Oct. 27, 1993, Pat. No. 5,460,882.

[30] Foreign Application Priority Data

Oct. 29, 1992 [IT] Italy ..... MI92A2476

[51] Int. Cl.[6] ..... D01D 5/088; D01D 5/16; D01F 6/32

[52] U.S. Cl. ..... 264/103; 264/210.8; 264/211.14

[58] Field of Search ..... 264/103, 210.8, 264/211.14

[56] References Cited

U.S. PATENT DOCUMENTS

| | | |
|---|---|---|
| 2,946,763 | 7/1960 | Bro et al. . |
| 2,952,669 | 9/1960 | Bro . |
| 3,132,123 | 5/1964 | Harris, Jr. et al. . |
| 3,561,441 | 2/1971 | Lombardi . |
| 3,770,711 | 11/1973 | Hartig et al. . |
| 4,029,868 | 6/1977 | Carlson . |
| 4,259,048 | 3/1981 | Miani . |
| 4,381,387 | 5/1983 | Sulzbach . |
| 4,510,300 | 4/1985 | Levy . |
| 4,510,301 | 4/1985 | Levy . |
| 4,552,925 | 11/1985 | Nakagawa et al. . |
| 4,667,175 | 6/1987 | Ihara et al. . |
| 4,675,380 | 6/1987 | Buchmaster et al. . |
| 4,883,716 | 11/1989 | Effenberger et al. . |
| 5,277,943 | 1/1994 | Adiletta et al. . |

OTHER PUBLICATIONS

Dictionary of Fiber & Textile Technology, 1965, p. 143.

European Search Report dated Mar. 1, 1994, with Annex to the European Search Report on European Patent Application No. EP 93 11 6783.

Chem. Abstract vol. 110, No. 8, 20 Feb. 1989 Abstract No. 59434n, Hirotaka Nishiyama et al.

*Primary Examiner*—Leo B. Tentoni

*Attorney, Agent, or Firm*—Bryan Cave LLP

[57] ABSTRACT

A multifilament yarn of a thermoplastic polymer based on tetrafluoroethylene, having high mechanical strength and dimensional stability at high temperatures (200°–250° C.), is prepared by melt extrusion through a die characterized by a hole density comprised between 10 and 150 holes/cm$^2$ and provided with a cooling system of the emerging yarn of high efficiency and uniformity. The multifilament yarn can be subsequently drawn to obtain a fiber with even further improved tensile strength and modulus.

9 Claims, No Drawings

PROCESS OF MAKING MULTIFILAMENT YARNS OF THERMOPLASTIC POLYMERS BASED ON TETRAFLUOROETHYLENE

This is a divisional of U.S. application Ser. No. 08/457,095, filed on Jun. 1, 1995, now U.S. Pat. No. 5,552,219, which is a divisional of U.S. application Ser. No. 08/144,189, filed on Oct. 27, 1993, now U.S. Pat No. 5,460,882.

The present invention relates to a multifilament yarn of a thermoplastic polymer based on tetrafluroethylene, characterized by very good mechanical properties, and in particular by high tensile strength and low shrinkage at high temperatures, and to the fiber obtained therefrom.

The thermoplastic polymers based on tetrafluoroethylene (TFE) are well known products in the art. They are obtained by copolymerization of TFE with other fluorinated monomers having side groups which have the effect to regulate the crystallinity degree of the end product.

Such products have the typical chemical and mechanical properties of polytetrafluoroethylene (PTFE) (chemical inertia, corrosion resistance, thermal stability, low friction coefficient, etc.) and moreover, differently from what happens for PTFE, can be melt-processed according to conventional techniques (extrusion, molding, etc.), commonly used for thermoplastic polymers.

A typical processing is spinning by melt extrusion, from which yarns or fibers can be obtained-to be employed in the manufacture of fabrics or non-woven, in their turn utilizable, for example, for the manufacture of filters for industrial use, especially suitable to be used in chemically aggressive environments and at high temperatures, or for biomedical use.

For such purposes, the yarn obtained from the die, after having been submitted, if the case, to drawing, can be either utilized as continuous yarn or crimped and subsequently cut. In the latter case, the so obtained staple fibers can be sent to additional textile steps, included weaving, or submitted to felting for the production of non-woven.

For the above mentioned uses it is necessary to have a yarn formed by filaments which are as thin as possible, having a diameter generally not higher than 150–200 μm, and having high mechanical strength. In consideration of the use at high temperatures, where other yarns made of thermoplastic material cannot operate owing to the strong decay of the tensile properties, it is essential that the tensile strength keeps on high values also at temperatures of 200°–250° C.

Moreover, the yarn, when submitted to such temperatures, must show a good dimensional stability, that is, the length variation (shrinkage), measured after cooling down to room temperature, must be as low as possible.

To this purpose, the Applicant has now found that it is possible to obtain a multifilament yarn of a thermoplastic polymer based on TFE, formed by a plurality of filaments having the diameter comprised between 10 and 150 μm, and having very good mechanical characteristics also at high temperatures (200°–250° C.), by an extrusion process of the polymer in the molten state through an extrusion die characterized by a high hole density and provided with a cooling system of the extruded yarn of high efficiency and uniformity.

This multifilament yarn can be subsequently drawn to obtain a drawn multifilament yarn with even further improved tensile strength and modulus, taking advantage of the orientation that occurs within the multifilament yarn when it is drawn at a suitable temperature.

A first object of the present invention is, therefore, a multifilament yarn of a thermoplastic polymer of tetrafluoroethylene, consisting of a plurality of filaments having a diameter comprised between 10 and 150 μm, preferably between 20 and 80 μm, and having an ultimate tensile strength at 200° C. at least double with respect to a specimen of the same polymer obtained by compression molding according to ASTM D3307 or ASTM2116 standard, and a maximum shrinkage at 200° C. lower than 10%.

For polymers having a melting temperature of at least 280° C., such as the polymers of TFE with perfluoroalkylvinylethers, the maximum shrinkage is lower than 10% also at 250° C.

The above mentioned limit values refer to the yarn directly obtained from the die, not submitted to subsequent drawing processes.

A second object of the present invention is a fiber obtained from the multifilament yarn described above.

A further object of the present invention is a process for the production of a multifilament yarn of a tetrafluoroethylene thermoplastic polymer having the above mentioned characteristics, in which said polymer is extruded in the molten state through an extrusion die having a hole density comprised between 10 and 300 holes/cm$^2$, preferably between 10 and 150 holes/cm$^2$, and provided with a cooling system such as to obtain the polymer solidification at an outlet distance from the die lower than 15 times the hole diameter of the die.

Preparing the yarn by extrusion through a die characterized by a so high hole density, besides increasing the productivity, has a direct influence on the characteristics of the end product, both as regards the mechanical properties, in particular at high temperatures, and as regards the surface characteristics of the yarn. In fact, under the same global feeding rate, the shear rate gradient at the wall of a single hole is maintained below the typical limit at which the onset of surface defects on the extrudate occurs. Consequently, the process object of the present invention permits to obtain yarns characterized by a smooth and regular surface, with manifest advantages for the workability of the yarn itself.

Moreover, the high hole density in the extrusion die permits to operate also with polymers having a relatively high viscosity, higher than that commonly employed for the extrusion of thermoplastic polymer yarns. It is therefore possible to use TFE polymers with a Melt Flow Index (MFI) lower than 18 g/10', and preferably comprised between 6 and 18 g/10'. This fact allows to improve the yarn mechanical properties both at room temperatures and at high temperatures.

A cooling system of high efficiency, such as to obtain cooling rates as the ones above mentioned, allows to obtain a quicker polymer solidification and therefore, presumably, a better orientation of the macromolecules along the yarn axis. An improvement of the mechanical properties ensues therefrom.

In order to determine the distance at which the polymer solidification occurs (that is the so named freeze-line), various methods are known in the art. For example, an indicative test is the variation of optical properties (in particular of the refraction index) of the solid (opaque) with respect to the molten (transparent) material. Such a variation can be evidenced by illuminating the yarn under a suitable angle of incidence.

Indicative values for the mechanical properties of the multifilament yarn object of the present invention are reported in the following Table 1. They refer to a TFE/perfluoropropylvinylether copolymer (1.5% mole of vinylether), having MFI of 16 g/10', measured according to ASTM D1238 and D3307 standards, with an average diameter of the filaments comprised between 10 and 150 μm.

TABLE 1

| Temperature | 23° C. | 200° C. | 250° C. |
|---|---|---|---|
| Modulus(*) (MPa) | 800–1000 | 90–120 | 40–60 |
| Ultimate tensile strength(*) (MPa) | 50–80 | 20–45 | 12–20 |
| Ultimate elongation (%)(*) | 40–70 | 100–150 | 120–180 |
| Max. shrinkage(**) (%) | — | ≦5 | 5–10 |

(*)ASTM 1708 Method;
(**)ASTM D 2102-87 Method.

It is important to point out that the values reported in Table 1 refer to the yarn as such, directly obtained from the die. The mechanical properties can be further improved by submitting the yarn to a drawing process below the melting point, according to well known methods in the art. For instance, is possible to use a double set of godet cans rolling at different speeds, in order to give the desired draw ratio, then passing the yarn into an air oven of suitable length and set on the desired temperature below the melting point of the polymer. Finally, the drawn yarn can be submitted to stabilization processes, which have the purpose of minimizing shrinking phenomena.

The properties of the yarn submitted to drawing depend, as known, from the variables of the employed process, such as the draw ratio, the draw speed and the temperature. Indicative values for the mechanical properties of the fibers obtained by drawing the multifilament of the TFE/ perfluoropropylvinylether copolymer described above are the following (measured at 23° C. according to ASTM 1708 standard):

| | |
|---|---|
| Modulus | 1800–2200 MPa |
| Ultimate tensile strength | 140–220 MPa |
| Ultimate elongation | 10–30% |

The yarn object of the present invention can be advantageously obtained by extrusion across a die as the one described in U.S. Pat. No. 4,259,048, the text of which is herein incorporated by reference. Such extrusion die comprises a feeding channel opening into an extrusion chamber of substantially cylindrical Shape. The extrusion chamber comprises, on the opposite side with respect to the feeding channel, an extrusion die having an annular configuration, arranged around the feeding channel and provided with a plurality of calibrated holes across which the yarn is extruded. The fact to operate with an extrusion die having an annular configuration, assures an even distribution of the material to be extruded and therefore the constancy of the yarn characteristics. The extrusion die is equipped with a blower, directly inserted into the die, inside the ring of the extrusion die. The blower comprises a central suction duct, internally provided with a flow divider which has the function to distribute the air flow arriving in the suction duct through a plurality of radial channels evenly arranged so that to form a discoidal nozzle which opens into an annular slit, whose outlet is located near the extrusion die. A laminar discoidal air jet is thus formed, directed from the inside to the outside, capable of quickly and uniformly cooling the emerging filaments.

In comparison with the traditional extrusion heads, the particular configuration of such a die allows to operate with a much higher hole density, such as to meet the requirements of the present invention. It also affords the further advantage to provide a particularly efficient and uniform cooling system of the emerging filament.

Depending on the diameter of the single filament that is to be obtained, the holes in the extrusion die, generally having a circular shape, can have a diameter ranging between 0.3 and 1.5 mm.

Another parameter of the extrusion process is the draw ratio, that is the ratio between the take-up rate of the yarn and the outlet rate from the die holes, which is generally set on the typical high values for TFE thermoplastic polymers, which are characterized by high drawing capability in the molten state. Such values are generally comprised between 50 and 250, preferably between 50 and 150.

The process for preparing the multifilament yarn and subsequent fiber object of the present invention can be advantageously performed in a spinning plant having the following basic configuration:

one extruder, optionally equipped with a gear pump;

the head and the die equipped with the cooling system described hereinabove;

a first set of godet cans, optionally equipped with a spin finish system;

a heating oven, preferably air heated;

a second set of godet cans, in order to obtain the desired draw ratio.

The high hole density of the die allows to keep spinning speeds consistent with the subsequent drawing speeds and therefore the two processes can be performed simultaneously with considerable time and room savings. For example, plant configurations like the one described above are built and sold by MECCANICHE MODERNE S.p.A., Busto Arsizio, Italy.

Since the thermoplastic polymers based on TFE are generally corrosive for normal nitrided and construction steels used for melt-processing conventional polymers, a simple equipment configuration as that described above has a further advantage of reducing the costs for a corrosion resistant plant.

The TFE thermoplastic polymers employable in the process object of the present invention can be selected from:

(a) TFE polymers with at least one perfluoroalkylvinylether, where the alkyl group has from 1 to 4 carbon atoms, such perfluoroalkylvinylether being present in amounts comprised between 1 and 5% by mole;

(b) TFE polymers with at least one perfluoroolefin having from 3 to 8 carbon atoms, such perfluoroolefin being present in amounts comprised between 2 and 20% by mole.

Within class (a), TFE/perfluoropropylvinylether copolymers (PFA), TFE/perfluoromethylvinylether copolymers (MFA), and TFE/perfluoromethylvinylether/perfluoropropylvinylether terpolymers are particularly preferred.

As regards class (b), specific perfluoroolefins copolymerizable with TFE are: hexafluoropropene, perfluorobutene, perfluoroisobutene, perfluorooctene, and the like. The TFE/hexafluoropropene copolymers (FEP) are particularly preferred. According to the present invention the polymers belonging to class (b) are also employable, to which it is added in small amounts a further fluorinated comonomer, possibly containing also hydrogen and/or chloro atoms, having a vinylether structure, according to what described, for example, in U.S. Pat. No. 4,675,380. The amount of this further comonomer is generally lower than 5% by mole, so that the product has in any case thermoplastic and not elastomeric characteristics.

The multifilament yarns of thermoplastic polymers based on TFE, object of the present invention, constitute a valid alternative to the PTFE yarns, which, because of a very high molecular weight and consequently of a very high viscosity in the molten state, can be manufactured only through complex and expensive spinning processes.

The present invention will be now better described by the following examples, which are given only for illustrative purposes and cannot anyway be construed as limitative of the scope of the invention itself.

EXAMPLE 1

The plant employed for the yarn extrusion is constituted by the following essential parts:

- an extruder, having screw diameter of 45 mm, with length/diameter ratio of 30;
- a gear pump for the dosage of melted polymers, with nominal volume per revolution equal to 20 ml;
- an extrusion die, built according to what described in U.S. Pat. No. 4,259,048, provided with 3000 holes arranged in such a way as to form a ring (density: 32 holes/$cm^2$), with a nominal diameter of 0.5 mm;
- a drawing group, formed by 5 rollers, the take-up rate of which is adjustable at will between 0 and 200 m/min.

For the test a commercial product has been employed, identified as HYFLON® PFA 460. It is a TFE copolymer with perfluoropropylvinylether (1.5% by mole), having a MFI, measured according to ASTM D3307 standard, equal to 16.3 g/10', and a melting temperature of 308° C.

The extruder barrel and the connection flange with the gear pump have been heated by three distinct thermoregulation groups; it was made analogously for the casing of the pump and for the die, each heated with a different thermoregulating group. The temperature profile has been set so as to measure on the melted polymer a temperature of about 400° C.

The flow rate of the polymer has been set through regulation of the gear pump equal to about 12.6 Kg/hour. The number of revolutions of the extruder screw has been regulated at about 40 rpm, so as to maintain the pump feed constant.

The die cooling system has been provided, according to what described in the U.S. Pat. 4,259,048, by using a laminar air flow radially directed from the inside towards the outside, having a speed of 3 m/sec. The air flow outlet was positioned at a distance of about 1 cm from the filament outlet.

The group of drawing rollers has been regulated so as to have a take-up speed of about 18 m/min, such as to have a draw ratio of about 75.

In such conditions, the shear rate gradient at the wall of each hole has been maintained around to 64 $sec^{-1}$, that is, below the typical limit for the onset of surface defects on the extrudate.

The so obtained yarn has been submitted to mechanical characterization, according to ASTM 1708 standard. The results are reported in Table 2, where they are compared with the data (in brackets) obtained for a specimen prepared by compression molding of the same copolymer, according to ASTM D 3307 standard.

TABLE 2

| Temperature | 23° C. | 200° C. | 250° C. |
|---|---|---|---|
| Modulus(*) (MPa) | 830 (550) | 112 (55) | 47 (40) |
| Ultimate tensile strength(*) (MPa) | 55 (25) | 29 (10) | 14.3 (7) |
| Ultimate elongation (%)(*) | 62 (350) | 105 (450) | 125 (550) |
| Max. shrinkage(**) (%) | — | 5.0 | 6.1 |

(*)ASTM 1708 Method;
(**)ASTM D 2102-87 Method.

The tests have been carried out with a drawing rate of 50 mm/min and at an initial distance between the clamps of 50 mm. The modulus values have been calculated on the basis of the stress measured at 20% of the strain.

The nominal diameter of the yarn, measured by a microscope ×500 on 5 filament yarns randomly chosen from the bundle, resulted to be equal to 48 μm.

Subsequently, the multifilament yarn was drawn at 200° C with a draw ratio of 1:2.2. The so obtained fiber, having a diameter of 32–35 μm, showed a modulus of 2000 MPa and a ultimate tensile strength of 180 MPa (measured at 23° C. according to ASTM 1708 standard).

EXAMPLE 2

The same extrusion equipment described in Example 1 was used to prepare a yarn of TEFLON® FEP 100, a TFE copolymer with hexafluoropropene (6.9% by mole), having a MFI, measured according to ASTM D2116 standard, equal to 7 g/10', and a melting temperature of 263° C. The processing conditions were the same of Example 1, except that a take-up speed of 12 m/min was used and the temperature profile of the extruder has been set so as to measure on the melted polymer a temperature of about 380° C.

A multifilament yarn having a nominal diameter of 62–69 μm was obtained. The mechanical characteristics are reported in Table 3, where they are compared with the data (in brackets) obtained for a specimen prepared by compression molding of the same copolymer, according to ASTM D2116 standard.

TABLE 3

| Temperature | 23° C. | 200° C. | 250° C. |
|---|---|---|---|
| Modulus(*) (MPa) | 1130 (546) | 30 (25.3) | — |
| Ultimate tensile strength(*) (MPa) | 91 (24.5) | 9.8 (3.5) | — |
| Ultimate elongation (%)(*) | 101 (323) | 88 (327) | — |
| Max. shrinkage(**) (%) | — | 9.0 | — |

(*)ASTM 1708 Method;
(**)ASTM D 2102-87 Method.

Subsequently, the multifilament yarn was drawn at 200° C. with a draw ratio of 1:1.5. The so obtained fiber, having a diameter of 55–65 μm, showed a modulus of 1600 MPa and a ultimate tensile strength of 100 MPa (measured at 23°to ASTM 1708 standard).

EXAMPLE 3

The same extrusion equipment described in Example 1 was used to prepare a yarn of HYFLON® MFA 640, a TFE terpolymer with perfluoromethylvinylether (3.5% by mole)

and perfluoropropylvinylether (0.4% by mole), having a MFI, measured according to ASTM D3307 standard, equal to 13.4 g/10', and a melting temperature of 288° C. The processing conditions were the same of Example 1, except that a take-up speed of 12 m/min was used.

A multifilament yarn having a nominal diameter of 59–65 μm was obtained. The mechanical characteristics are reported in Table 4, where they are compared with the data (in brackets) obtained for a specimen prepared by compression molding of the same terpolymer, according to ASTM D 3307 standard.

TABLE 4

| Temperature | 23° C. | 200° C. | 250° C. |
|---|---|---|---|
| Modulus(*) (MPa) | 910 (510) | 49 (33) | 14 (15) |
| Ultimate tensile strength(*) (MPa) | 79 (27.7) | 19 (7.6) | 8.6 (3.7) |
| Ultimate elongation (%)(*) | 71 (356) | 91 (390) | 105 (387) |
| Max. shrinkage(**) (%) | — | 7.6 | 10 |

(*)ASTM 1708 Method;
(**)ASTM D 2102-87 Method.

Subsequently, the multifilament yarn was drawn at 200° C. with a draw ratio of 1:2.2. The so obtained fiber, having a diameter of 42–49 μm, showed a modulus of 2060 MPa and a ultimate tensile strength of 153 MPa (measured at 23° C. according to ASTM 1708 standard).

We claim:

1. A process for the production of a multifilament yarn of a thermoplastic polymer based on tetrafluoroethylene with a Melt Flow Index (MFI) lower than 18 g10' according to ASTM D2116 standard, said multifilament yarn consisting of a plurality of filaments, wherein each filament of said multifilament yarn has a diameter between 10 and 150 μm, an ultimate tensile strength at 200° C. at least double with respect to a specimen of the same polymer obtained by compression molding according to the ASTM D3307 or ASTM D2116 standard, and a maximum shrinkage at 200° C. lower than 10%, said process comprising:

extruding said thermoplastic polymer in the molten state through an extrusion die having a plurality of holes and having a hole density of from 10 to 300 holes/cm$^2$, and directly obtaining said yarn from said extrusion die, wherein said extrusion die is provided with a cooling system which provides polymer solidification of said filaments at an outlet distance from the die lower than 15 times the hole diameter of the die.

2. The process according to claim 1, wherein the extrusion die has a hole density of from 10 to 150 holes/cm$^2$.

3. The process according to claim 1, wherein the holes of the extrusion die have a diameter of from 0.3 to 1.5 mm.

4. The process according to claim 1, further comprising obtaining a draw ratio of said thermoplastic polymer of from 50 to 250.

5. The process according to claim 4, in which the draw ratio is from 50 to 150.

6. The process according to claim 2, wherein the holes of the extrusion die have a diameter of from 0.3 to 1.5 mm.

7. The process according to claim 2, further comprising obtaining a draw ratio of said thermoplastic polymer of from 50 to 250.

8. The process according to claim 3, further comprising obtaining a draw ratio of said thermoplastic polymer of from 50 to 250.

9. The process according to claim 2, further comprising extrusion of said thermoplastic polymer through a die having holes with a diameter of from 0.3 to 1.5 mm and obtaining a draw ratio of said thermoplastic polymer of from 50 to 150.

* * * * *

UNITED STATES PATENT AND TRADEMARK OFFICE

CERTIFICATE OF CORRECTION

PATENT NO : 5,618,481

DATED : April 8, 1997

INVENTOR(S) : Giandomenico Vita, et al.

It is certified that error appears in the above-identified patent and that said Letters Patent are hereby corrected as shown below:

Column: 7, Line 33: Delete: "g10'" Insert --g/10'--

Signed and Sealed this

Thirtieth Day of December, 1997

*Attest:*

*Attesting Officer*

BRUCE LEHMAN

*Commissioner of Patents and Trademarks*